US007789051B2

(12) United States Patent
Nakamura

(10) Patent No.: US 7,789,051 B2
(45) Date of Patent: Sep. 7, 2010

(54) VARIABLE VALVE ACTUATING APPARATUS FOR INTERNAL COMBUSTION ENGINE

(75) Inventor: Makoto Nakamura, Atsugi (JP)

(73) Assignee: Hitachi, Ltd., Tokyo (JP)

( * ) Notice: Subject to any disclaimer, the term of this patent is extended or adjusted under 35 U.S.C. 154(b) by 548 days.

(21) Appl. No.: 11/774,862

(22) Filed: Jul. 9, 2007

(65) Prior Publication Data

US 2008/0011253 A1 Jan. 17, 2008

(30) Foreign Application Priority Data

Jul. 12, 2006 (JP) ..... 2006-191178

(51) Int. Cl.
*F01L 1/34* (2006.01)

(52) U.S. Cl. ..... 123/90.15; 123/90.17; 123/348

(58) Field of Classification Search ..... 123/90.15, 123/90.16, 90.17, 90.18, 345, 346, 347, 348, 123/90.12, 90.13
See application file for complete search history.

(56) References Cited

FOREIGN PATENT DOCUMENTS

| | | | |
|---|---|---|---|
| JP | 04179837 A | * | 6/1992 |
| JP | 2003-35115 A | | 2/2003 |
| JP | 2003-172112 A | | 6/2003 |
| JP | 2005-233049 A | | 9/2005 |

OTHER PUBLICATIONS

U.S. Appl. No. 11/808,320, filed Jun. 8, 2007, Nakamura et al.

* cited by examiner

*Primary Examiner*—Ching Chang
(74) *Attorney, Agent, or Firm*—Foley & Lardner LLP

(57) ABSTRACT

A variable valve actuating apparatus for an internal combustion engine includes a valve actuating mechanism to vary an actual valve operating characteristic of the engine. A controller sets a target valve operating characteristic in accordance with a crank angle position of the engine before a start of the engine, and delivers a changeover control signal to the valve actuating mechanism to control the actual valve operating characteristic to the target valve operating characteristic before an end of a cranking operation of the engine.

8 Claims, 13 Drawing Sheets

VARIABLE VALVE ACTUATING APPARATUS FOR INTERNAL COMBUSTION ENGINE

BACKGROUND OF THE INVENTION

The present invention relates to variable valve operating or actuating apparatus and/or process suitable for improving engine starting performance.

There is a demand for accurate control of a valve timing (opening timing and/or closing timing) of an engine valve, especially of an intake valve at an initial stage of an engine starting operation, for recent stringent regulations against exhaust emission, and increase of frequency of engine restarts in a hybrid vehicle.

Accordingly, there are proposed various valve actuating apparatus for controlling the opening and closing timings of an engine valve in accordance with an engine operating condition by varying a relative rotational phase between a timing sprocket and a vane fixed to a camshaft by the use of oil pressure.

In the case of such a hydraulic actuating mechanism, when the engine speed is very low as in an engine starting operation, a control oil pressure is low and the hydraulic power for changeover is insufficient. Moreover, the actuating mechanism tends to receive an urging force in the direction to the retard side, opposite to the cranking rotational direction, and to suffer friction in various parts. Consequently, the changeover response speed to the advance side is liable to be low.

A published Japanese patent application publication number 2005-233049 shows a variable valve actuating system including a phase varying mechanism which is provided on an intake valve's side, and arranged to fix a vane at a relatively advanced position with a lock pin at the time of stop of the engine, and to enable a restart of the engine from the relatively advance position. The thus-constructed variable valve actuating system is expected to stabilize the combustion by providing an adequate valve overlap between the exhaust and intake valves, and setting the intake valve closing time closer to the bottom dead center, and thereby to reduce cold engine emission and improve the engine starting performance.

SUMMARY OF THE INVENTION

However, in the variable valve actuating system of the above-mentioned patent document, the improvement in the engine starting performance is limited because the valve timing or valve operating characteristic is constant irrespective of the crank angle before a start of an engine or the piston stop position of each cylinder.

It is, therefore, a main object of the present invention to provide variable valve actuating apparatus and/or process to improve the startability or starting performance of an engine more reliably. It is another object to improve the startability or starting performance of an engine more reliably by varying the valve operating characteristic in accordance with the crank angle before the engine start.

According to a first aspect of the present invention, a variable valve actuating apparatus for an internal combustion engine, comprises: a valve actuating mechanism to vary an actual valve operating characteristic (of an engine valve) of the engine; and a controller to set a target valve operating characteristic (to satisfy an engine starting condition), in accordance with an engine stop condition such as a crank angle position (of a crank shaft) of the engine before a start of the engine, and to control the actual valve operating characteristic to the target valve operating characteristic by sending a changeover control signal to the valve actuating mechanism before an end of a cranking operation of the engine.

According to the first aspect of the present invention, the variable valve actuating apparatus may further have any one or more of the following features. (1) The controller may be further configured to start the cranking operation after the changeover control signal is delivered. (2) The valve actuating mechanism may be constructed so that the valve actuating mechanism includes only one of a valve lift varying mechanism and a valve timing control mechanism. (3) The controller may be configured to perform a crank angle adjusting operation to rotate a crank shaft of the engine to a predetermined desired target starting crank angle position, to set the target valve operating characteristic in accordance with the crank angle adjusting operation, to control the valve actuating mechanism to the target valve operating characteristic, and thereafter to perform the cranking operation. In this case, the valve actuating mechanism may include either or both of the valve lift varying mechanism and the valve timing control mechanism. (4) The controller may be configured to perform a crank angle adjusting operation to rotate a crank shaft of the engine to a predetermined desired target starting crank angle position (Q3) with a starter motor (of a reversible type), to set the target valve operating characteristic in accordance with a result (such as the target crank angle position or the crank angle sensed after the crank angle adjusting operation) of the crank angle adjusting operation, to control the valve actuating mechanism to the target valve operating characteristic, and thereafter to perform the cranking operation.

According to the first aspect of the present invention, the variable valve actuating apparatus may have the following feature (5), in addition to any one or more of the above-mentioned features (1)~(4), or with none of these features. (5) The controller may be further configured to examine an engine stop position determined from the actual crank angle (and/or cam angle), to determine whether the engine stop position is normal or not. The controller judges the engine stop position to be not normal when there is one cylinder which is on the intake or compression stroke and which has a piston position that is not separated from the bottom dead center sufficiently (or by a sufficient separation greater than or equal to a predetermined amount). The controller sets the target valve operating characteristic in a non-normal mode (at S7) when the engine stop position is not normal, and in a normal mode (at S6) when the engine stop position is normal.

According to the first aspect of the present invention, the variable valve actuating apparatus may have the following feature (6), in addition to any one or more of the above-mentioned features (1)~(5), or with none of these features. (6) The controller may be configured to perform a crank angle adjusting operation to rotate a crank shaft of the engine to a predetermined desired target starting crank angle position, to examine whether the crank angle adjusting operation is normal, and to perform a fail-safe control operation only when the crank angle adjusting operation is not normal. The fail-safe control operation is performed by setting the target valve operating characteristic in accordance with the crank angle sensed after the crank angle adjusting operation, and controlling the actual valve operating characteristic to the target valve operating characteristic.

According to a second aspect of the present invention, a variable valve actuating apparatus for an internal combustion engine, comprises: a valve actuating mechanism to vary an actual valve operating characteristic of an engine valve of the engine; a crank angle sensing device to sense an actual crank angle or angular position of a crank shaft of the engine; and a controller to set a target crank angle position in accordance with an engine operating condition including the actual crank angle sensed by the crank angle sensing device, to perform a crank angle adjusting operation to rotate the crank shaft to the target crank angle position, to set a target valve operating characteristic in accordance with the actual crank angle controlled by the crank angle adjusting operation and sensed again by the crank angle sensing device, and to deliver a changeover control signal to the valve actuating mechanism to control the actual valve operating characteristic to the target valve operating characteristic.

According to a third aspect of the present invention, a variable valve actuating apparatus for an internal combustion engine, comprises: a valve actuating mechanism to vary an actual valve operating characteristic of an engine valve in each of a plurality of cylinders of the engine; and a controller to ascertain a crank angle of the engine before a start of the engine, to identify a cylinder having a lower piston position near a bottom dead center on an intake or compression stroke in accordance with the crank angle, to set a target valve operating characteristic in accordance with the piston position in the cylinder having the lower piston position, and to deliver a changeover control signal to the valve actuating mechanism to control the actual valve operating characteristic to the target valve operating characteristic before an end of a cranking operation of the engine.

According to a fourth aspect of the present invention, a control process of controlling a variable valve actuating apparatus including a valve actuating mechanism to vary a valve operating characteristic of the engine, the control process comprises: setting a target valve operating characteristic in accordance with an engine stop condition, and controlling the actual valve operating characteristic to the target valve operating characteristic before an end of a cranking operation of the engine.

According to the fourth aspect of the present invention, the control process may further have any one or more of the following features. (1) The control process may further comprise starting the cranking operation after a control operation of controlling the actual valve operating characteristic to the target valve operating characteristic. (2) The control process may further comprise performing a crank angle adjusting operation to rotate a crank shaft of the engine to a predetermined desired target starting crank angle position, setting the target valve operating characteristic in accordance with the crank angle adjusting operation, controlling the actual valve operating characteristic to the target valve operating characteristic, and performing the cranking operation after the crank angle adjusting operation and a control operation of controlling the actual valve operating characteristic to the target valve operating characteristic. (3) The target valve operating characteristic may be set in accordance with a result (such as the target crank angle position or the crank angle sensed after the crank angle adjusting operation) of the crank angle adjusting operation.

According to the fourth aspect of the present invention, the control process may have the following feature (4), in addition to any one or more of the above-mentioned features (1)~(3), or with none of these features. (4) The control process may further comprise examining an engine stop position determined from the actual crank angle (and/or cam angle), to determine whether the engine stop position is normal or not. The engine stop position is judged to be not normal when there is one cylinder which is on the intake or compression stroke and which has a piston position that is not separated from the bottom dead center sufficiently (or by a sufficient separation greater than or equal to a predetermined amount). The target valve operating characteristic is set in a non-normal mode (at S7) when the engine stop position is not normal, and in a normal mode (at S6) when the engine stop position is normal.

According to the fourth aspect of the present invention, the control process may include the following feature (5), in addition to any one or more of the above-mentioned features (1)~(4), or with none of these features. (5) The control process may comprise performing a crank angle adjusting operation to rotate a crank shaft of the engine to a predetermined desired target starting crank angle position, examining whether the crank angle adjusting operation is normal, and performing a fail-safe control operation only when the crank angle adjusting operation is not normal. The fail-safe control operation is performed by setting the target valve operating characteristic in accordance with the crank angle sensed after the crank angle adjusting operation, and controlling the actual valve operating characteristic to the target valve operating characteristic.

DETAILED DESCRIPTION OF THE INVENTION

Figure 1:
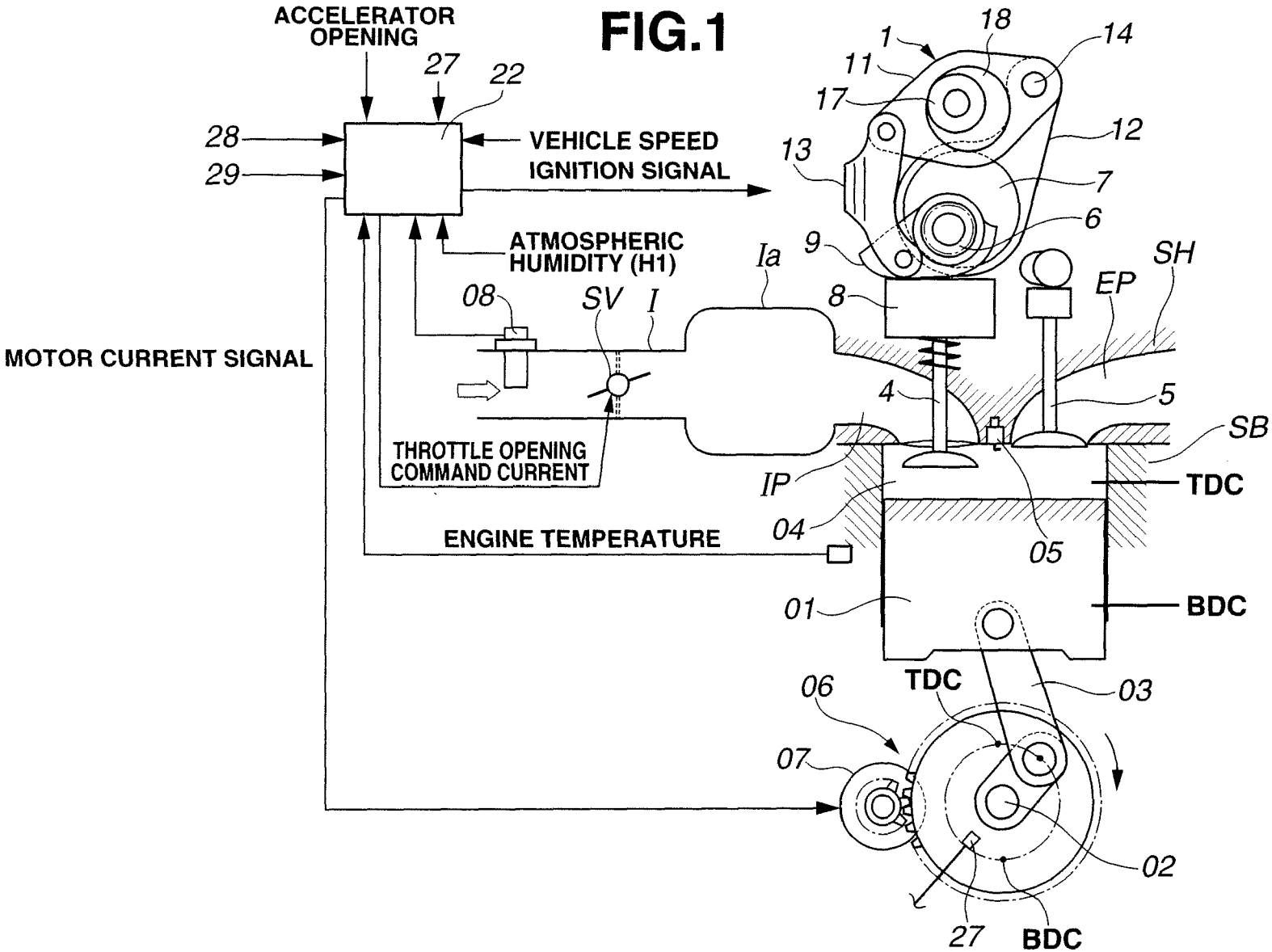
FIG. 1 is a schematic view showing an engine system including a variable valve actuating system or apparatus according to a first embodiment of the present invention.

FIG. 1 schematically shows an engine system including a variable valve actuating system or apparatus according to a first embodiment of the present invention. In this embodiment, the internal combustion engine is a four-cycle multi-cylinder internal combustion engine, and the variable valve actuating system is applied to the intake valve's side.

A cylinder bore shown in FIG. 1 is formed in a cylinder block SB of the engine. A piston 01 is received in this cylinder bore so that piston 01 can slide up and down in the cylinder bore. Intake and exhaust ports IP and EP are formed in a cylinder head SH. For each cylinder, there are provided a pair of intake valves 4, and a pair of exhaust valves 5 for opening and closing the respective open ends of the intake and exhaust ports. Piston 01 is connected with a crankshaft 02 through a connecting rod 03. A combustion chamber 04 is formed between the crown of piston 01 and a lower surface of cylinder head SH.

In an intake passage I on the upstream side of an intake manifold Ia, there is provided a throttle valve SV for controlling the quantity (intake air quantity) of air inducted into the combustion chamber 04. On the downstream side, there is provided a fuel injector (not shown). A spark plug 05 is provided in cylinder head SH substantially at the center of the combustion chamber 04.

An electric starter motor 07 is connected with the crankshaft 02 through a pinion gear mechanism 06, and arranged to rotate the crankshaft 02. In this example, starter motor 07 rotates only in one rotational direction, and thereby cranks crankshaft 02 in that rotational direction.

Figure 2:
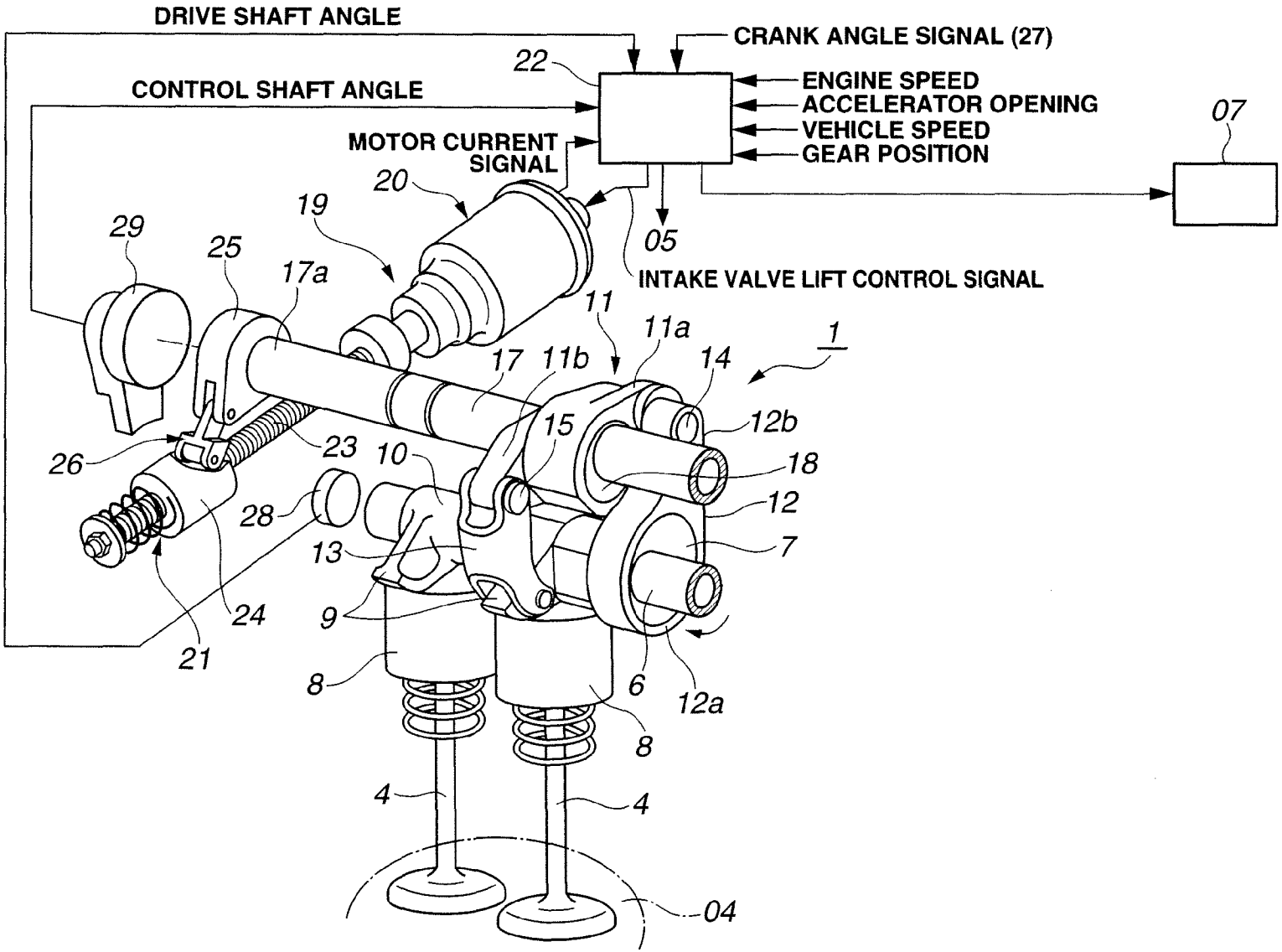
FIG. 2 is a perspective view showing a valve lift varying mechanism in the variable valve actuating system of FIG. 1.

A variable valve actuating mechanism includes a valve lift varying mechanism (VEL) 1 to control the valve lift and operation angle (opening period) of both intake valves 4, as shown in FIGS. 1 and 2.

The valve lift varying mechanism 1 has the construction substantially the same as the construction disclosed in a published Japanese patent application publication No. 2003-172112. Valve lift varying mechanism 1 includes a hollow drive shaft 6 which is rotatably supported by bearings on an upper part of cylinder head SH; a drive cam 7 which is an eccentric rotary cam fixedly mounted on drive shaft 6 by press fitting in this example; a pair of swing cams 9 which are swingably mounted on drive shaft 6, and arranged to open the intake valves 4, respectively, by sliding on top surfaces of valve lifters 8 provided in the upper ends of intake valves 4; and a linkage or motion transmitting mechanism arranged to transmit rotation of drive cam 7 to swing cams 9 for swing motion.

Drive shaft 6 is arranged to receive rotation from the crankshaft of the engine through a rotation transmitting mechanism which, in this example, is a chain drive including a timing sprocket (30) provided on one end of drive shaft 6, a driving sprocket provided on the crankshaft, and a timing chain (not shown). When driven by the crankshaft, the drive shaft 6 rotates in the clockwise direction as shown by an arrow in FIG. 2.

Drive cam 7 is shaped like a ring, and formed with a drive shaft receiving hole. Drive cam 7 is fixedly mounted on drive shaft 6 extending through the drive shaft receiving hole. The axis of drive cam 7 is offset in the radial direction from the axis of drive shaft 6 by a predetermined distance.

Swing cams 9 are both shaped identically like a raindrop, and formed integrally at both ends of an annular camshaft 10. The cam shaft 10 is hollow and rotatably mounted on drive shaft 6. Each swing cam 9 has a lower surface including a cam surface 9*a*. Cam surface 9*a* includes a base circle surface region on the cam shaft's side, a ramp surface region extending like a circular arc from the base circle surface region toward a cam nose, and a lift surface region extending from the ramp surface region toward an apex of the cam nose to provide a greatest lift. The cam surface abuts on the top surface of the corresponding valve lifter 8 at a predetermined position, and the contact point of the cam surface shifts among the base circle surface region, ramp surface region and lift surface region in dependence on the swing position of the swing cam 9.

The above-mentioned linkage or transmitting mechanism includes a rocker arm 11 disposed above drive shaft 6; a link arm 12 connecting a first end portion 11*a* of the rocker arm 11 with drive cam 7; and a link rod 13 connecting a second end portion 11*b* of rocker arm 11 with one swing cam 9.

Rocker arm 11 includes a tubular central base portion formed with a support hole, and rotatably mounted on a control cam 18. The first end portion 11*a* of rocker arm 11 is connected rotatably with link arm 12 by a pin 14, and the second end portion 11*b* is connected rotatably with a first end portion 13*a* of link rod 13 by a pin 15.

Link arm 12 includes a relatively large annular base portion 12*a* and a projection 12*b* projecting outward from the base portion 12*a*. Base portion 12*a* is formed with a center hole in which the cam portion of the drive cam 7 is rotatably fit. The projection 12*b* is connected rotatably with the first end portion 11*a* of rocker arm 11 by a pin 14.

Link rod 13 includes a second end 13*b* which is connected rotatably with the cam nose of swing cam 9 by the pin 16.

Control shaft 17 is rotatably supported by the same bearings at a position just above drive shaft 6; and control cam 18 is fixedly mounted on control shaft 17 and fit slidably in the support hole of rocker arm 11 to serve as a fulcrum for the swing motion of rocker arm 11.

Control shaft 17 extends in parallel to drive shaft 6 in the longitudinal direction of the engine, and is controlled by a drive mechanism 19. Control cam 18 is shaped like a hollow cylinder, and the axis of control cam 18 is offset from the axis of the control shaft 17 by a predetermined amount.

Drive mechanism 19 includes an electric motor 20 which is fixed to one end of a housing; and a transmission mechanism 21 to transmit rotation of the motor 20 to the control shaft 17. In this example, the transmission mechanism 21 is a ball screw transmission mechanism.

Electric motor 20 of this example is a proportional type DC motor. Electric motor 20 is controlled by a controller 22 in accordance with an engine operating condition.

Controller 22 is connected with various sensors to collect information on a current engine operating state. Controller 22 receives an output signal from a crank angle sensor 27 for sensing the crank angle of crank shaft 02, to determine the current crank angle and a current engine speed N (rpm) from the crank angle, and a signal from an air flowmeter for sensing an intake air quantity (load). Controller 22 is further connected with an accelerator opening sensor for sensing an accelerator opening degree, a vehicle speed sensor, a gear position sensor, and an engine temperature sensor for sensing an engine temperature T1 by sensing the temperature of engine cooling water. Furthermore, controller 22 receives a sensor signal from a drive shaft angle sensor 28 for sensing the rotational angle of drive shaft 6; and a humidity signal representing an atmospheric humidity H1 sensed by an atmospheric humidity sensor. Moreover, controller 22 is connected with a control shaft angle sensor 29 for sensing the rotational angular position of the control shaft 17, and arranged to receive a sensor signal from control shaft angle sensor 29, and to determine the current operating or actuating position or the operation angle (lift) of the valve lift varying mechanism 1 by calculation.

Ball screw transmission mechanism 21 includes a ball screw shaft 23, a ball nut 24, a connection arm 25 and a link member 26. Ball screw shaft 23 and the drive shaft of motor 20 are arranged end to end and aligned with each other so that their axes form a substantially straight line. Ball nut 24 serves as a movable nut screwed on the ball screw shaft 23 and arranged to move axially in accordance with the rotation. Connection arm 25 is connected with one end portion of control shaft 17. Link member 26 connects the connection arm 25 and ball nut 24.

Ball screw shaft 23 is formed with an external single continuous ball circulating groove extending, in the form of a helical thread of a predetermined width, over the outside surface of ball screw shaft 23 excepting both end portions. Ball screw shaft 23 and the drive shaft of motor 20 are connected end to end by a coupling member which transmits a rotational driving force from motor 20 to ball screw shaft 23, and allow ball screw shaft 23 to move axially to a limited small extent. 7

Ball nut 24 is approximately in the form of a hollow cylinder. Ball nut 24 is formed with an internal guide groove designed to hold a plurality of balls in cooperation with the ball circulating groove of ball screw shaft 23 so that the balls can roll between the guide groove and the circulating groove. This guide groove is a single continuous helical thread formed in the inside circumferential surface of ball nut 24. Ball nut 24 is arranged to translate the rotation of ball screw shaft 23 into a linear motion of ball nut 24 and produce an axial force. A coil spring 21 is provided to urge the ball nut 24 axially toward electric motor 20, and thereby to eliminate a backlash clearance with ball screw shaft 23.

The thus-constructed valve lift varying mechanism is operated in the following manner. In a predetermined engine operating region, the controller 22 acts to move the ball nut 24 rectilinearly toward motor 20, by sending control current to motor 20 and rotating the ball screw shaft 23 with motor 20. With this movement of ball nut 24, the control shaft 17 is rotated in one direction by the link member 39 and connection arm 25.

Figure 3A:
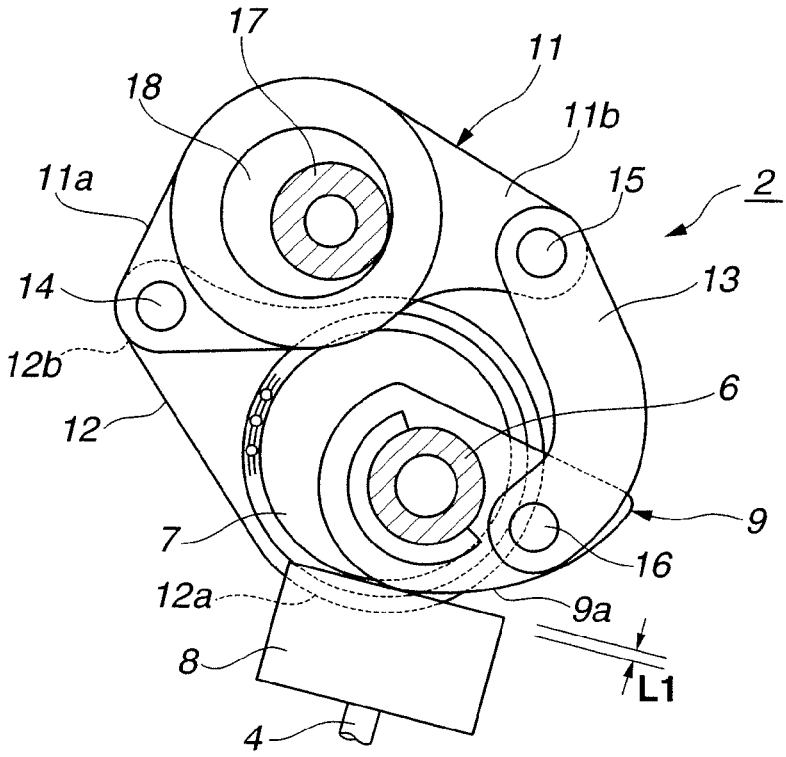
FIGS. 3A and 3B are views for illustrating operation of the valve lift varying mechanism in a small lift control state.
Figure 3B:
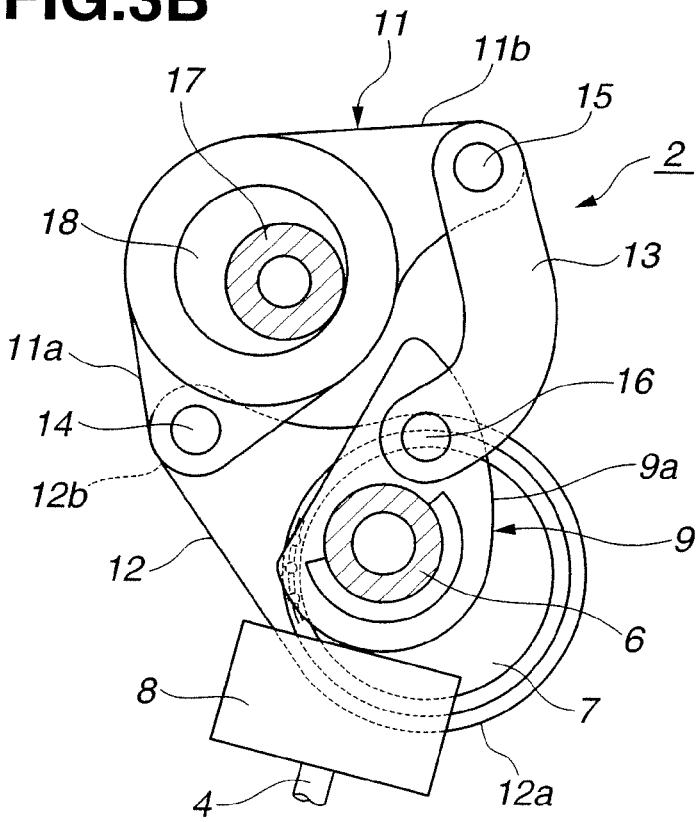

Therefore, control cam 18 rotates about the axis of control shaft 17 so that the axis of control cam 18 rotates about the axis of control shaft 17, as shown in FIGS. 3A and 3B (in the form of rear view), and a thick wall portion is shifted upwards from drive shaft 6. As a result, the pivot point between the second end portion 11*b* of rocker arm 11 and link rod 13 is shifted upwards relative to the drive shaft 6. Therefore, each swing cam 9 is rotated in the counterclockwise direction as viewed in FIGS. 3A and 3B, and the cam nose is pulled upwards by link rod 13.

Accordingly, drive cam 7 rotates and pushes up the end 11*a* of rocker arm 11 through link arm 12. Though a movement for valve lift is transmitted through link rod 13 to swing cam 9 and valve lifter 16, the valve lift quantity is decreased sufficiently to a small valve lift L1 shown in FIG. 3, and the operation angle D is decreased to a small value D1 (valve opening period).

Therefore, the variable valve actuating system can provide the effect of decompression, the effect of small lift and low friction, and the effect of reduction of fuel consumption.

In another engine operating region, the controller 22 drives motor 20 in a reverse rotational direction, and thereby rotates the ball screw shaft 23 in the reverse direction. With this reverse rotation, the ball nut 24 moves in the axial direction away from motor 20, and control shaft 17 is rotated in the counterclockwise direction as viewed in FIGS. 3A and 3B by a predetermined amount. Therefore, the control cam 18 is held at the angular position at which the axis of control cam 18 is shifted downward by a predetermined amount from the axis of control shaft 17, and the thick wall portion is shifted downwards. Rocker arm 11 is moved in the clockwise direction from the position of FIGS. 3A and 3B, and the end of rocker arm 11 pushes down the cam nose of swing cam 9 through link member 13, and swing cam 9 rotates in the clockwise direction slightly.

Accordingly, drive cam 7 rotates and pushes up the end 11*a* of rocker arm 11 through link arm 12. A movement for valve lift is transmitted through link member 13 to swing cams 9 and valve lifters 8. In this case, the valve lift quantity is increased to a medium lift L2, and the operation angle is increased to a medium angle D2. By this control operation, the variable valve actuating system can shift the intake valve closing timing on the retard side toward the bottom dead center. By so doing, the variable valve actuating system can improve the combustion in a cold start operation with a higher effective compression ratio, and increase the fresh air charging efficiency to increase the combustion torque.

In a low speed low load region after a warm-up of the engine, the variable valve actuating system can control the valve lift to the small level L1. In this case, the variable valve actuating system can stabilize the combustion by decreasing the valve overlap, and improve the fuel consumption by decreasing the friction for actuating the valves in the small lift.

In a medium load region, the variable valve actuating system can control the valve lift to the medium lift L2 or a level slightly greater than L2. In this case, the variable valve actuating system can shift the intake valve closing timing to the bottom dead center or slightly on the retard side, and thereby increase the torque by improving the intake charging efficiency in this operating region.

Figure 4A:
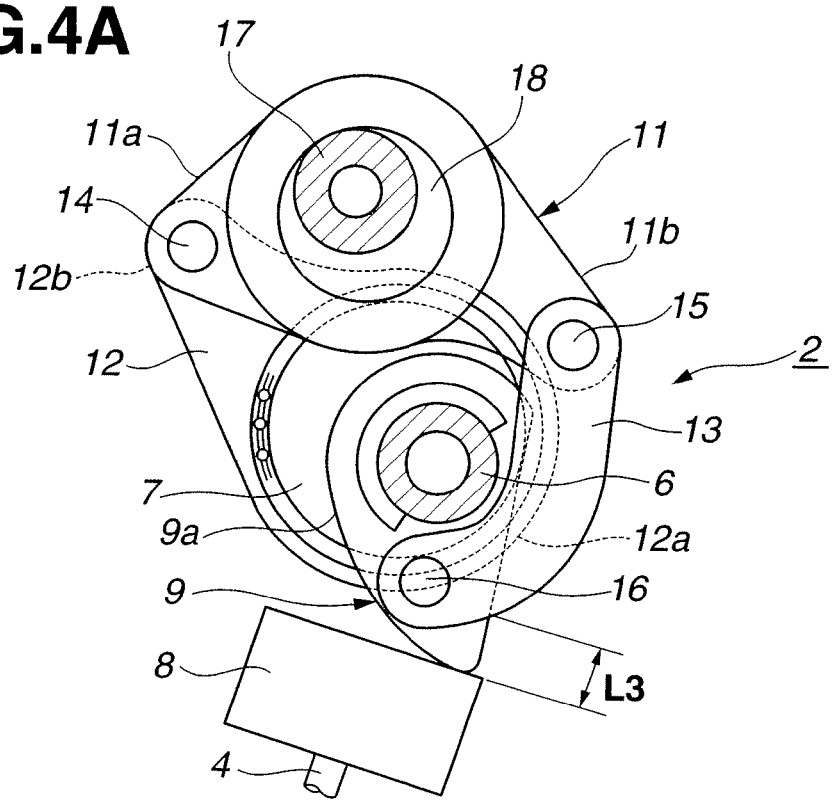
FIGS. 4A and 4B are views for illustrating operation of the valve lift varying mechanism in a greatest lift control state.
Figure 4B:
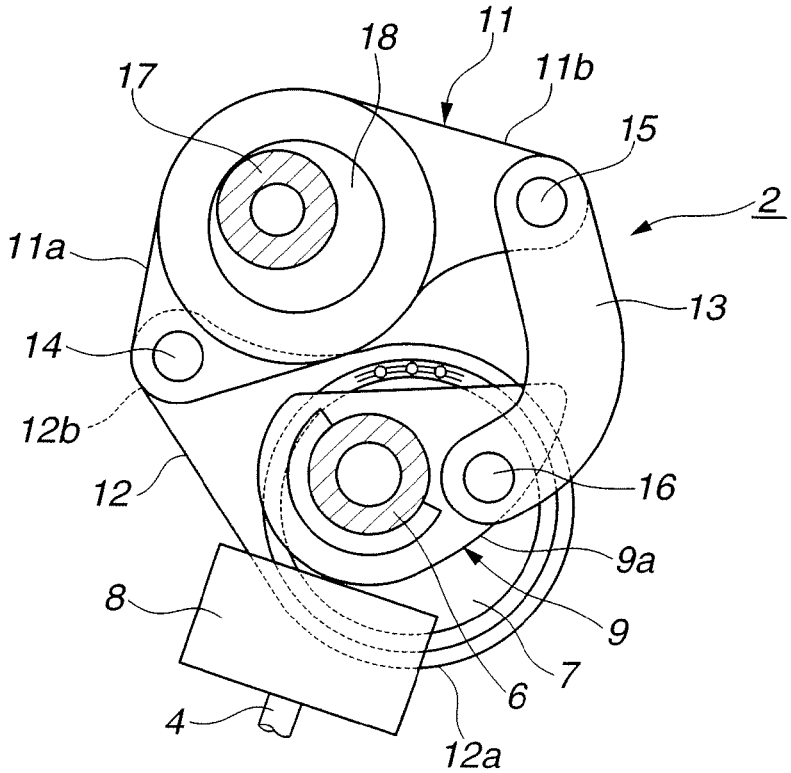

When the engine operating point enters a high speed, high load region, this variable valve actuating system can rotate motor 20 in the reverse direction by sending the control signal from controller 22, to rotate control cam 18 further in the counterclockwise direction with control shaft 17 to the position at which the axis is rotated downwards as shown in FIGS. 4A and 4B. Therefore, rocker arm 11 moves to a position closer to the drive shaft 6, and the second end 11*b* pushes down the cam nose of swing cam 9 through link rod 13, so that the swing cam 9 is further rotated in the clockwise direction by a predetermined amount.

Accordingly, drive cam 7 rotates and pushes up the first end 11*a* of rocker arm 11 through link arm 12. A movement for valve lift is transmitted through link rod 13 to swing cam 9 and valve lifter 8. In this case, the valve lift quantity is increased continuously from L2 to L3 as shown in FIG. 4, and the operation angle is increased continuously from D2 to D3. In this way, this system can improve the intake charging efficiency and the engine output in the high speed region.

In this way, this variable valve actuating mechanism 1 is arranged to vary the valve lift (quantity) of the engine valve (which, in this example, includes intake valves 4) continuously from the small lift L1 to the large lift L3 in accordance with one or more engine operating conditions. Accordingly, the operation angle of the engine valve is varied continuously from the small angle (angular distance) D1 to the large angle D3.

Figure 5:
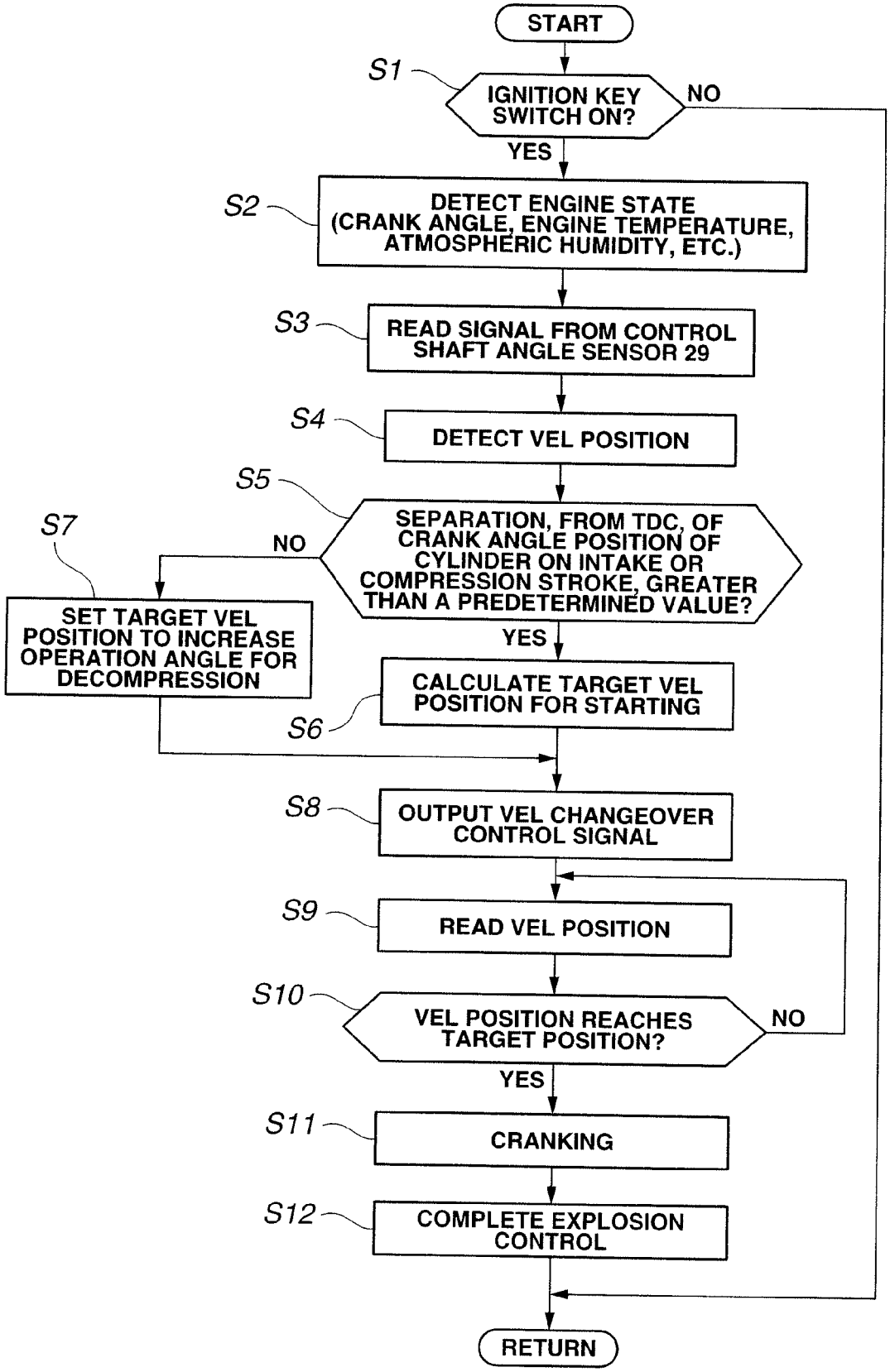
FIG. 5 is a flow chart showing a control process performed by a controller in the variable valve actuating system of FIG. 1.

FIG. 5 shows a control process performed by the controller 22 to improve the startability of the engine.

At a step S1, controller 22 examines whether the ignition key switch for the engine is on or not. When the ignition key switch is off (not on), controller 22 proceeds directly to the end (return) of the process of FIG. 5 since the engine is in the stop state. When the ignition key switch is on, controller 22 proceeds to a step S2.

At step S2, controller 22 detects a current engine operating state by reading signals on information including the actual crank angle representing the current crank angle phase, sensed by crank angle sensor 27, the engine temperature (or engine coolant temperature) T1 from the engine coolant temperature sensor, the atmospheric humidity H1 from the atmospheric humidity sensor, etc. Moreover, from the drive shaft angle sensor 28 (which is an absolute angle sensor), controller 22 reads the current drive shaft angle of drive shaft 6, that is the cam angle.

At a step S3, controller 22 reads the current control shaft angle of control shaft 17 from control shaft angle sensor 29.

At a step S4, controller 22 detects a current operating or actuating position (current VEL position) of the valve lift varying mechanism 1 or a current operation angle (lift), from information on angular position supplied from the control shaft angle sensor 29.

At a step S5, controller 22 checks the piston position in at least one cylinder on the intake stroke or the compression stroke by using the current crank angle read from crank angle sensor 27 or the cam angle read from drive shaft angle sensor 28, and examines whether the piston position (crank angle position) in the cylinder on the intake stroke or the compression stroke is away from the bottom dead center by a separation (or distance) greater than or equal to a predetermined value.

Figure 6:
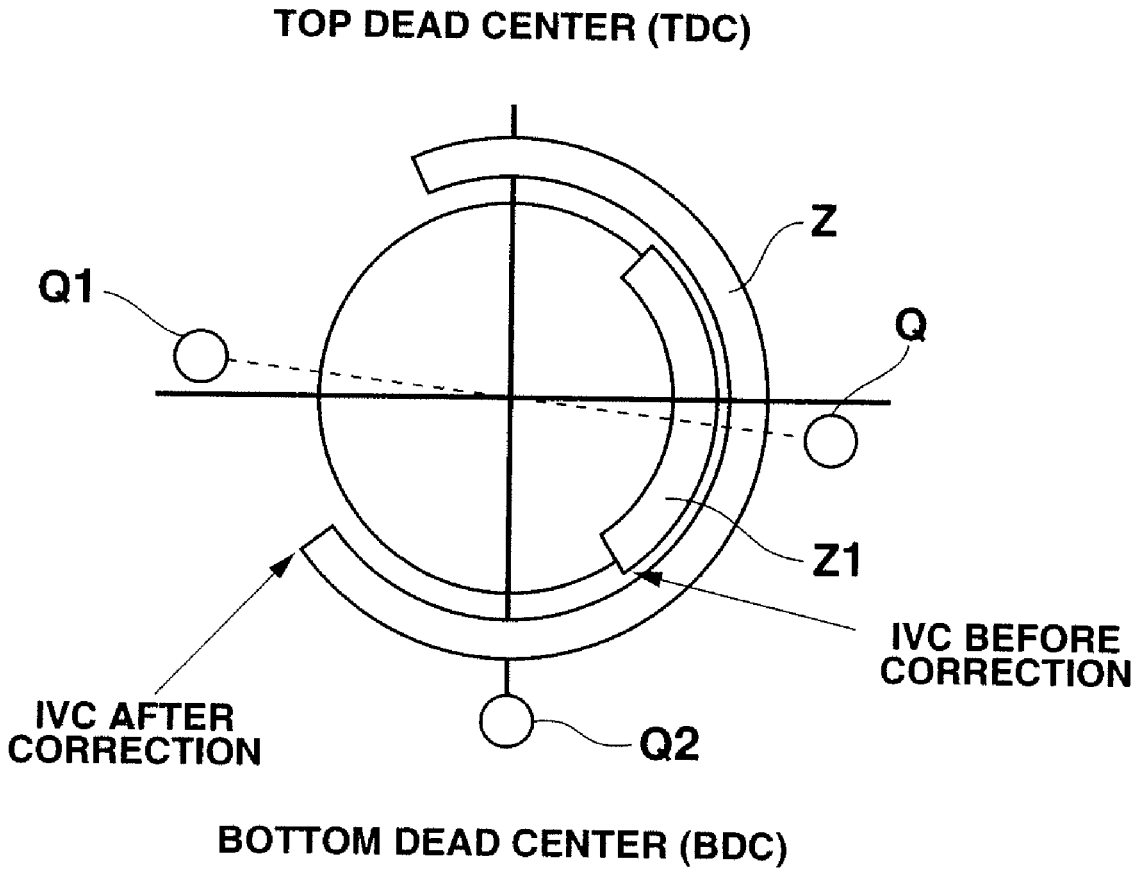
FIG. 6 is a characteristic view illustrating a corrective operation performed by the controller to shift the intake valve closing timing with the lift varying mechanism.
Figure 7:
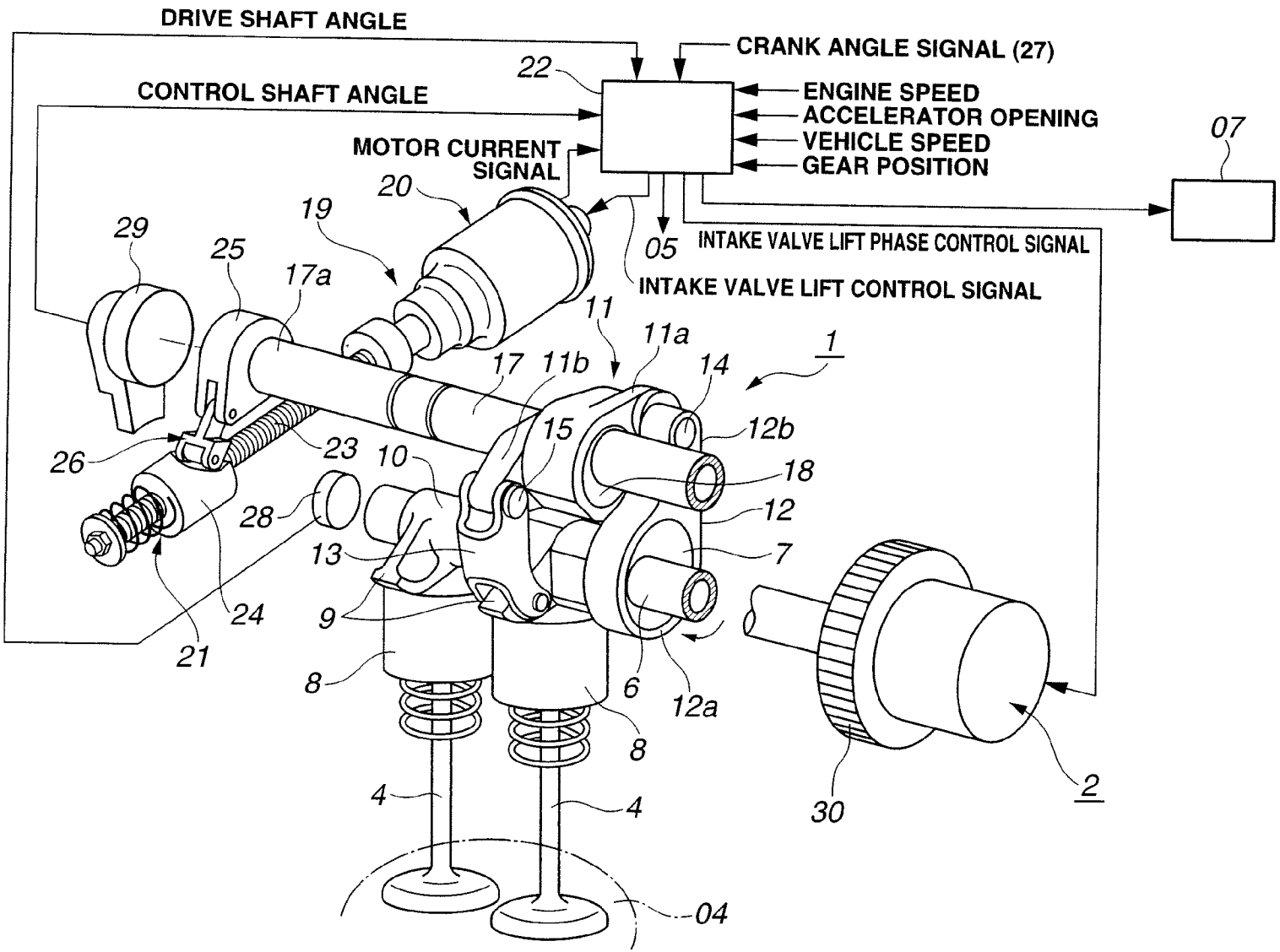
FIG. 7 is a perspective view showing a valve lift varying mechanism and a valve timing control mechanism in a variable valve actuating system according to a second embodiment.

When two or more cylinders are on the intake or compression stroke, controller 22 identifies a piston having a lower or lowest piston position nearest to the bottom dead center, and checks, at S5, the lowest piston position closest to the piston bottom dead center. When the separation of the lowest piston position on the intake or compression stroke from the bottom dead center is greater than or equal to the predetermined value, the crank stop position or engine stop position is often a normal position Q (which is a frequent stop position) as shown in FIG. 6, because, at the time of stop of the engine, the piston position of another cylinder on the compression stroke is located at a position Q1 (with a phase difference of 180° in the four cylinder engine). The piston position tries to rotate from position Q1 toward the top dead center on the compression stroke. However, the piston position is pushed back in the counterclockwise direction by the high incylinder pressure applied to the piston. As a result, the piston on the intake stroke settles down at or near the position Q.

In this state, the answer of step S5 becomes affirmative. Therefore, controller 22 proceeds from S5 to a step S6, and calculates a target VEL position of lift varying mechanism 1 adapted to the engine starting operation, in accordance with the engine temperature T1 and the atmospheric humidity H1.

When the engine temperature T1 is low, the mechanical friction increases, and the torque produced by the engine tends to become small. Therefore, as shown in FIG. 6, the controller 22 determines the target VEL position so as to increase the intake valve operation angle and to shift the intake valve closing timing IVC to the retard side to the side of the bottom dead center. By so doing, the system can increase the intake air quantity (combustion torque) to a level suitable for the increase of the friction. When the atmospheric humidity H1 is higher, the output torque decreases, and hence the intake air quantity (volume) required to start the engine increases. Therefore, controller 22 determines the target VEL position so as to increase the intake valve operation angle similarly.

However, the answer of step S5 is not always YES. When the piston in the cylinder on the compression stroke is pushed back in the counterclockwise direction, the stop position of the piston is determined by the friction nonuniformly. If the friction is great, the piston on the intake stroke might stop at a position Q2 near bottom dead center (BDC) shown in FIG. 6. In this case, the following problem can arise in a next start of the engine.

When the piston is stopped at position Q2 near bottom dead center BDC in the cylinder on the intake stroke, air enters the cylinder through a clearance between the piston and the cylinder after the stop. Therefore, in the next engine start, the air is compressed by a full stroke of the piston from the bottom dead center to the top dead center, and the excessive compression might cause undesired vibrations in the engine starting operation.

When the engine temperature is high, this excessive compression might cause spontaneous ignition, so called pre-ignition, of fuel remaining in the cylinder, resulting in abnormal noises and damage to the piston by impact.

Therefore, when the piston in a cylinder on the intake or compression stroke stops at a position near the bottom dead center, the answer of step S5 becomes negative, and controller 22 proceeds from S5 to a step S7.

At step S7, controller 22 determines the target VEL position so as to increase the operation angle Z to avoid the above-mentioned problem. Thus, the intake valve closing timing IVC is retarded after the bottom dead center by a predetermined amount (cf. FIG. 6). Accordingly, during the ascending motion from the bottom dead center, the piston pushes out a predetermined amount of air out of the cylinder, and the compression starts from the position of IVC after bottom dead center. As a result, the effective compression ratio becomes smaller, and the system can prevent vibrations and pre-ignition due to excessive compression, and thereby provide smooth engine starting performance.

Even if the piston in one cylinder is stopped at or near the bottom dead center at the time of stoppage of the engine, the intake valves are held open for a while after the bottom dead center, and the air is discharged from the cylinder during the first cranking operation. Thus, the valve actuating system can reduce the engine starting noise and increase the cranking speed by the effect of pressure decease (or the effect of decompression).

Moreover, the target VEL position of the valve lift varying mechanism 1 is slightly adjusted to the retard side or the advance side in accordance with the engine operating state. When, for example, the engine temperature T1 is high, the system corrects the target VEL position to the retard side (in a direction to increase the operation angle) slightly to improve the ability to avoid pre-ignition. When the engine temperature T1 is low, the friction increases, and the torque becomes smaller. Therefore, the system corrects the target VEL position to the advance side (in a direction to decrease the operation angle, toward the bottom dead center) slightly, and thereby increases the intake air quantity. When the atmospheric humidity H1 is high, the torque becomes smaller as in the decrease of engine temperature T1. Therefore, the system corrects the target VEL position to the advance side (in a direction to decrease the operation angle, toward the bottom dead center) slightly when the atmospheric humidity H1 becomes high.

At a step S8 following S7 or S6, controller 22 delivers an operation changeover control signal to valve lift varying mechanism 1, to control or change over the lift varying mechanism 1 to the target VEL position determined at S6 or S7.

At a step S9, controller 22 reads the current VEL position of lift varying mechanism 1 sensed by control shaft angle sensor 29.

At a step S10, controller 22 examines the current VEL position to determine whether the VEL target position is reached or not. Controller 22 returns to S9 when the current VEL position is not yet shifted to the target VEL position, and proceeds to a step S11 when the current VEL position of lift varying mechanism 1 has reached the target VEL position.

At S11, controller 22 starts the engine cranking operation by energizing the starter motor 07. At a step S12, controller 22 performs the fuel injection and ignition and performs the complete explosion control with the valve timing suitable for the first cranking. Therefore, the control system can ensure the satisfactory starting performance, restraining vibrations and pre-ignition and taking account of the engine operating condition and the atmospheric condition. The complete explosion control is a control to bring the engine from combustion by cranking to the state in which the engine can rotate in self-sustaining manner (that is, the state of idling operation).

In this way, the control system can achieve the optimum opening and closing timings (valve timing) of an engine valve with the valve lift varying mechanism 1, during cranking, in accordance with the crank angle before cranking, and thereby improve the engine starting performance.

FIGS. 7~10 shows a variable valve actuating system according to a second embodiment of the present invention. The basic construction of the variable valve actuating system of the second embodiment is identical to the basic construction shown in FIGS. 1 and 2, except for the variable valve actuating mechanism. The variable valve actuating mechanism according to the second embodiment includes a valve timing control mechanism (VTC) or variable valve timing mechanism 2 in addition to the valve lift varying mechanism (VEL) 1. The valve timing control mechanism 2 is known per se. In this example, valve timing control mechanism 2 has the construction as disclosed in a Published Japanese Patent Application Publication No. 2003-035115. Explanation and figures about the valve timing control mechanism in this Japanese document are hereby incorporated by reference. This valve timing control mechanism 2 includes a sprocket 30 which is formed in the outer circumference of a housing, and which is arranged to be driven by the crank shaft 02; and a control element which is coupled with the drive shaft 6 and received in the housing. The control element is actuated by a VTC electric motor, instead of hydraulic means, and arranged to vary a relative rotational phase between crank shaft 02 and drive shaft 6, and thereby to vary the opening and closing timings of intake valves 4 in accordance with the engine operating state.

Controller 22 controls the valve timing control mechanism 2 by sending an electric signal, as well as valve lift varying mechanism 1. Moreover, controller 22 is configured to sense the relative rotational position between timing sprocket 30 and drive shaft 6 from the signals from crank angle sensor 27 and drive shaft angle sensor 28.

In the second embodiment, the starter motor 07 shown in FIG. 1 is constructed to rotate in a forward direction and a reverse direction. With this starter motor 07 of the reversible type, the variable valve actuating system can adjust the crank angle phase of crank shaft 02 even in an engine stop state or in a very low engine speed state just before a stop of the engine.

Figure 8:
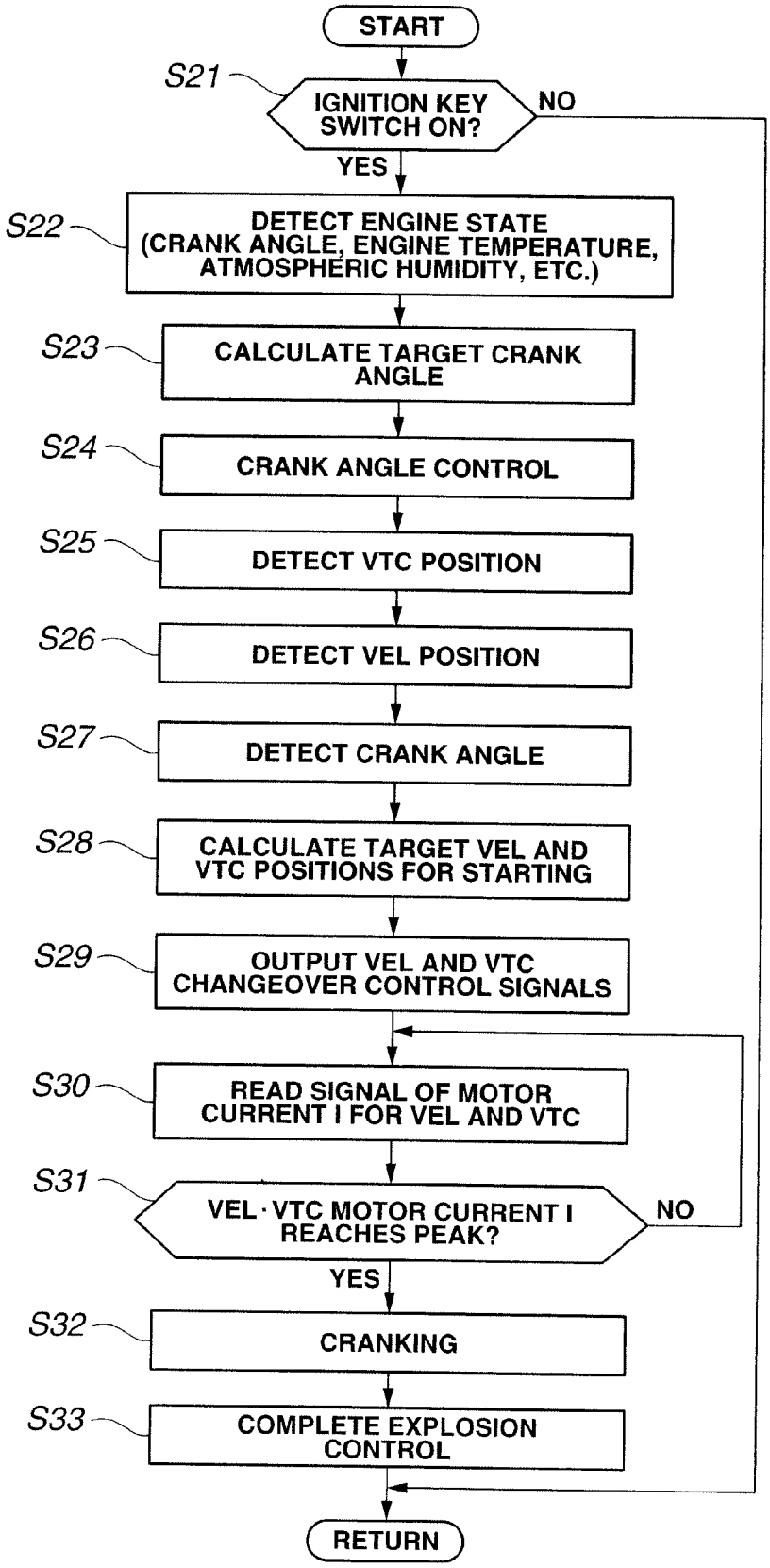
FIG. 8 is a flow chart showing a control process performed by a controller according to the second embodiment.

FIG. 8 show a control process performed by controller 22 according to the second embodiment.

At a step S21, controller 22 examines whether the ignition key switch is on or not. When the ignition key switch is not on, controller 22 proceeds directly to the end of the process of FIG. 8 since the engine is in the stop state. When the ignition key switch is on, controller 22 proceeds to a step S22.

At step S22, controller 22 detects a current engine operating state by reading signals on information including the current crank angle from crank angle sensor 27, the engine temperature (or engine coolant temperature) T1 from the engine coolant temperature sensor, the atmospheric humidity H1 from the atmospheric humidity sensor, etc.

At a step S23, controller 22 calculates a target crank angle. In the case of the ordinary four-cylinder engine, the target crank angle is set at such an angle that the piston position of a cylinder on the intake stroke is set about 90° before bottom dead center, in order to decrease the effective compression ratio to restrain vibrations in engine starting operation and avoid pre-ignition. When, on the other hand, the engine temperature is low, the target crank angle is so set as to shift the crank angle closer to bottom dead center in order to increase the effective compression ratio to improve the combustion and reduce the exhaust emission.

Figure 9:
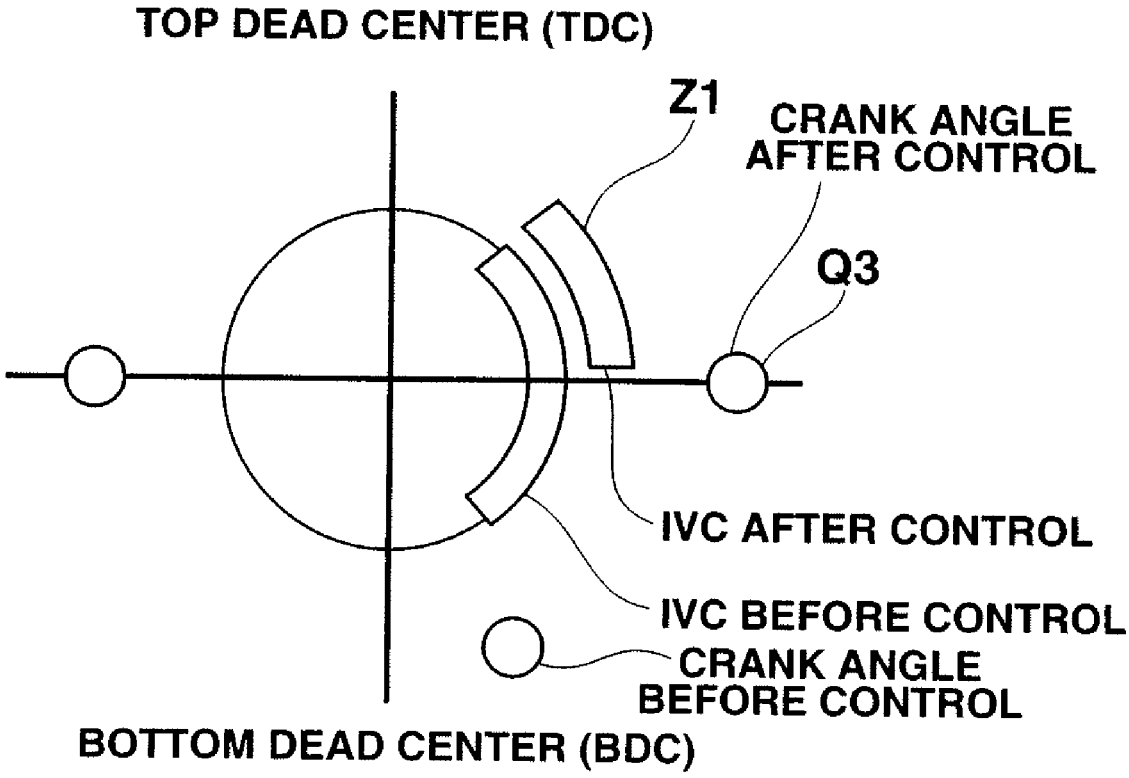
FIG. 9 is a characteristic view illustrating a crank angle adjusting operation and an intake valve operation angle varying operation performed by the controller according to the second embodiment.

In this example, on the assumption of a normal engine starting operation, controller 22 sets the target crank angle at a position Q3 shown in FIG. 9, that is, at or near 90° before bottom dead center.

At a step S24, controller 22 performs a crank angle adjusting control operation by rotating the crank shaft 02 in the forward direction or the reverse direction by energizing the starter motor 07, and controls the actual crank angle to the target crank angle.

At a step S25, controller 22 detects a current operating or actuating position (VTC position) of valve timing control mechanism 2 from information on angular positions supplied from the crank angle sensor 27 and drive shaft angle sensor 28 (absolute angle sensor).

At a step S26, controller 22 detects a current operating or actuating position (current VEL position) of the valve lift varying mechanism 1 or a current operation angle (lift), from the control shaft angle sensor 29.

At a step S27, controller 22 reads the current crank angle again to ascertain the crank angle position controlled by the crank angle control operation of S24.

At a step S28, controller 22 calculates a target VEL position and a target VTC position to gain satisfactory engine starting performance. In this example, the target VEL and VTC positions are determined so as to advance the intake valve closing timing (IVC) of intake valves 4 before the crank angle detected at S27. In this way, the variable valve actuating system can hold the effective compression ratio at the time of cranking at a compression ratio level determined by the crank angle Q3, and hence reduce the undesired engine starting vibrations reliably without erratic fluctuation. The atmospheric air is charged quickly into the cylinder at the crank angle position Q3. Therefore, when the intake valve closing timing (IVC) is set before the crank angle Q3, the effective compression ratio becomes independent from the intake valve closing timing. If IVC is retarded after Q3, the effective compression ratio is determined by IVC. The target intake valve opening timing (IVO) is set at or near an original position because by retarding the intake valve opening timing IVO more or less, it is possible to develop a negative pressure in the cylinder to increase an incylinder fluid motion at the time of the intake valve opening, and thereby to improve the combustion. From the thus-determined target intake valve opening timing (IVO) and target intake valve closing timing (IVC), controller 22 determines the target VEL position for valve lift varying mechanism 1 and the target VTC position for valve timing control mechanism 2 by calculation.

At a step S29, controller 22 delivers, to the motor 20, a current for controlling valve lift varying mechanism 1 to the target VEL position, and delivers, to the VTC motor, a current for controlling valve timing control mechanism 2 to the target VTC position. Therefore, valve lift varying mechanisms is set to the position producing the small operation angle Z1, and thereby reducing the valve operating friction in the cranking operation of a step S32. As a result, the variable valve actuating system can increase the cranking speed smoothly.

At a step S30, controller 22 ascertains a current sum I that is a sum of currents supplied to the motor 20 and the VTC motor. Then, at a step S31, controller 22 examines whether the current sum I reaches or passes a peak.

Figure 10:
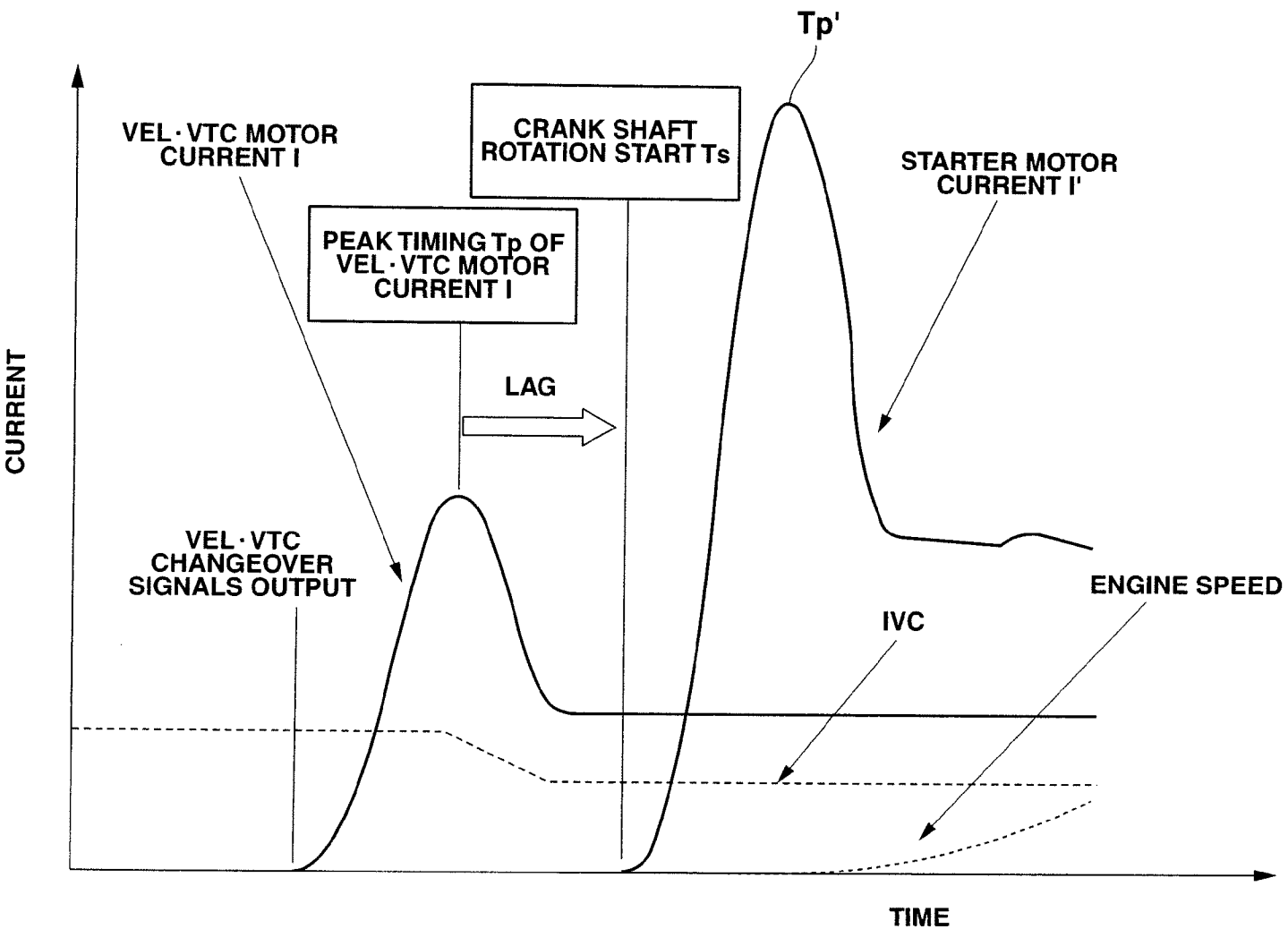
FIG. 10 is a characteristic view showing a characteristic between a current and time, for illustrating a control operation of the controller according to the second embodiment to shift the peak position of a current for an electric motor of the valve lift varying mechanism away from the peak position of a current for a starter motor.

From S31, controller 22 returns to S30 when a peak is not yet reached by the current sum I. When the judgment is that the current sum I has passed or reached a peak, then the controller 22 proceeds to a step S32. At S32, controller 22 starts the engine cranking operation by energizing the starter motor 07. Thus, as shown in FIG. 10, the control system starts the cranking by supplying the electric power to starter motor 07 at an instant at which the current sum I to the electric motor 20 and the VTC motor has passed a peak Tp of the current sum I. Therefore, the control system can alleviate the load on the battery power source by preventing coincidence of the peak of the current sum for the electric motor 20 and the VTC motor and the peak Tp' of the current I' for the starter motor.

At a step S33 following S32, controller 22 performs a complete explosion control to control the fuel injection and ignition when the cranking is started and the rotational speed of the crank shaft 02 is increased, and thereby completes the smooth cranking operation.

Figure 11:
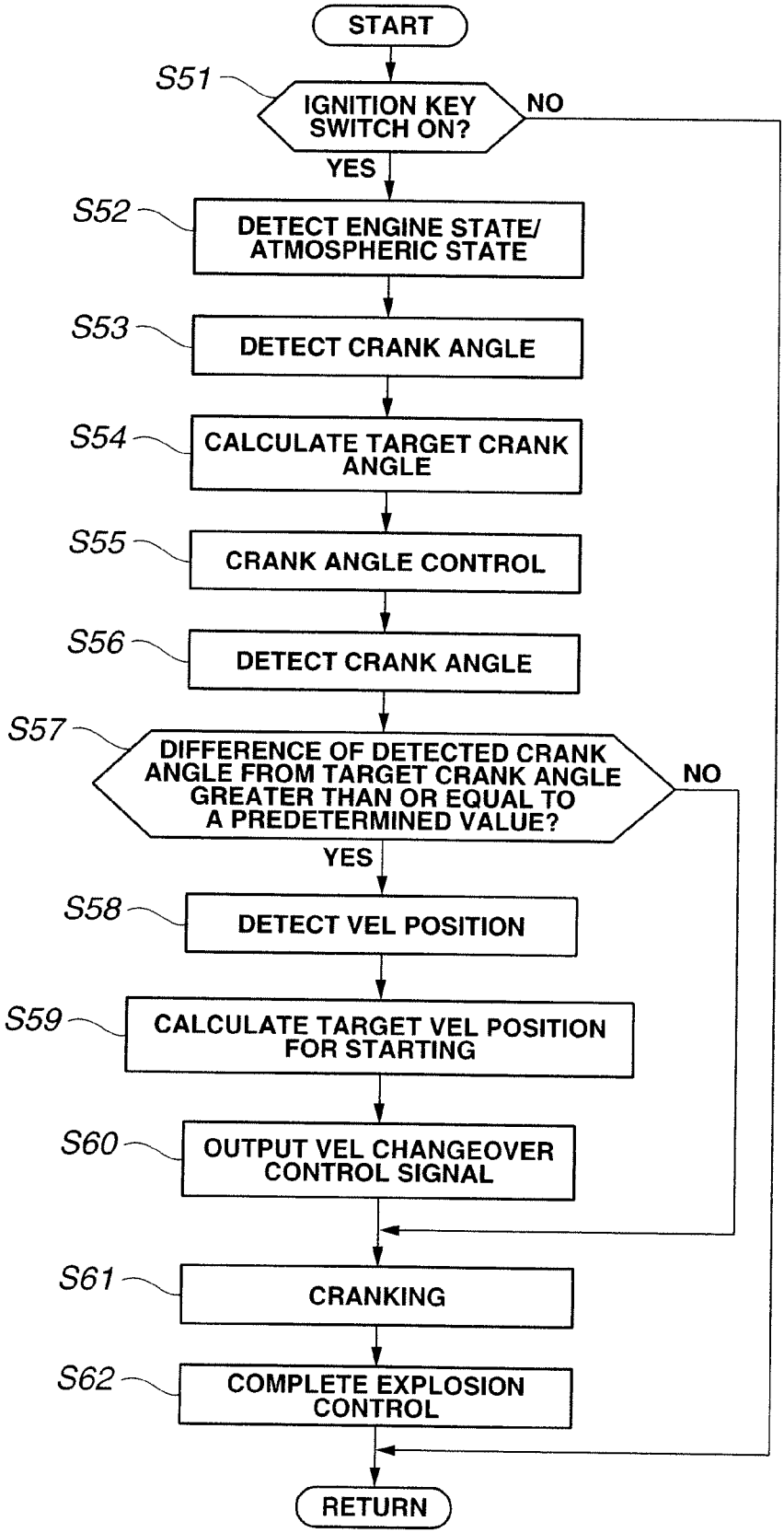
FIG. 11 is a flow chart showing a control process performed by a controller according to a third embodiment of the present invention.

FIG. 11 shows a control process performed by controller 22 according to a third embodiment. The control process of FIG. 11 is designed to perform a failsafe control in case of failure (or malfunction) of the starter motor 07. The mechanical construction of the third embodiment is substantially identical to that shown in FIGS. 1 and 2. The valve actuating mechanism of the third embodiment includes only the valve lift varying mechanism 1. The valve actuating mechanism of the third embodiment does not includes a valve timing control mechanism 2. The starter motor 07 is of the reversible type capable of rotating in the forward direction and the reverse direction as in the second embodiment.

At a step S51, controller 22 examines whether the ignition key switch is on or not. When the ignition key switch is off (not on), controller 22 proceeds directly to the end of the process of FIG. 11 since the engine is in the stop state. When the ignition key switch is on, controller 22 proceeds to a step S52.

At step S52, controller 22 detects a current engine operating state by reading signals on information including the engine main body temperature (or engine temperature) T1 from the engine coolant temperature sensor, the atmospheric humidity H1 from the atmospheric humidity sensor, etc.

Then, controller 22 detects the current crank angle with the crank angle sensor 27 at a step S53; and calculates a target crank angle of crank shaft 02 in accordance with the current engine operating state at a step S54.

At a step S55, controller 22 performs a crank angle control operation to rotate the crank shaft 02 by supplying current to the starter motor 07, and thereby controls the actual crank angle to the target crank angle.

At a step S56, controller 22 detects the actual crank angle again with crank angle sensor 27.

At a step S57, controller 22 checks a difference (or deviation) of the actual crank angle sensed at step S56, from the target crank angle, by comparing the difference with a predetermined value. When the difference is smaller than the predetermined value, the controller 22 proceeds to a step S61. When the difference between the actual crank angle and the target crank angle is greater than or equal to the predetermined value, the controller 22 assumes that the starter motor 07 is not working properly due to failure, and proceeds to a step 58 to start a failsafe control operation.

Figure 12:
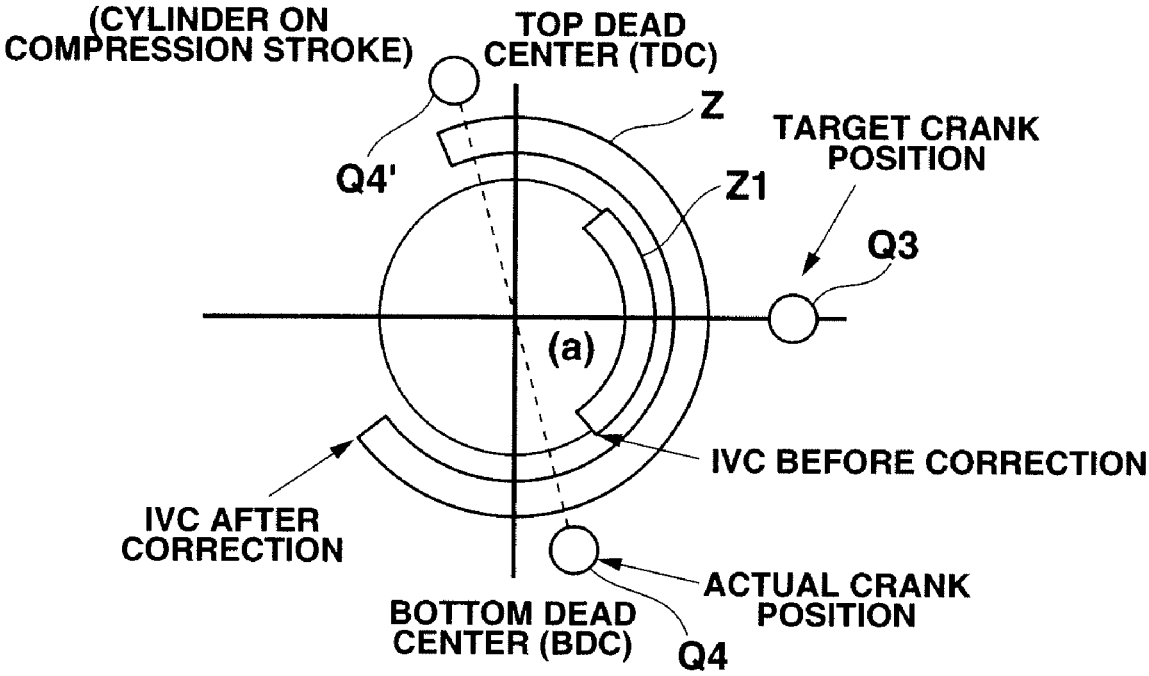
FIG. 12 is a characteristic view illustrating a crank angle adjusting operation and an intake valve operation angle varying operation performed by the controller according to the third embodiment.

In an example shown in FIG. 12, controller 22 proceeds from S57 to S58 if the actual crank angle position is at a point Q4 near bottom dead center while the target crank angle position is at a point Q3. At step S58, controller 22 detects a current control position (VEL position) of valve lift varying mechanism 1 with control shaft angle sensor 29 as mentioned before.

Thereafter, at step S59, controller 22 determines a target VEL position for engine starting on the basis of the cylinder closest to the intake bottom dead center (bottom dead center on the intake and compression strokes) as in the control process of FIG. 5 according to the first embodiment. In this example, the target VEL position is so set as to increase the operation angle Z of intake valves 4 with valve lift varying mechanism 1.

At a step S60, controller 22 delivers current to motor 20 and thereby controls the valve lift varying mechanism 1 so as to increase the intake valve operation angle. Therefore, the intake valve closing timing IVC is shifted to the retard side. Then, controller 22 starts the engine cranking operation with the starter motor 07 at a step 61; and performs the complete explosion control at a step S62 in the same manner as in step S12.

Therefore, the variable valve actuating system can decrease the effective compression ratio at the time of cranking by controlling the intake valve operation angle to a larger angle, and thereby restrain vibrations in engine starting and preignition. Even in case of a malfunction in starter motor 07, the variable valve actuating system can ensure satisfactory engine starting performance. In this example, the valve lift varying mechanism 1 is adjusted only when there occurs a malfunction in starter motor 07. Accordingly, the system can decrease the frequency of repetition of changeover operation of valve lift varying mechanism 1, and thereby improve the durability.

In the example shown in FIG. 12, another cylinder indicated at a point Q4' is on the intake or compression stroke. However, controller 22 controls the lift varying mechanism 1 by paying attention to the cylinder at position Q4 closer to bottom dead center. The cylinder at the position Q' remoter from bottom dead center is not so problematical in starting since the effective compression ratio is small enough. From this standpoint, the present invention is applicable to the six cylinder engine, and the eight cylinder engine as well as the four cylinder engine employed in the illustrated embodiments.

Figure 13:
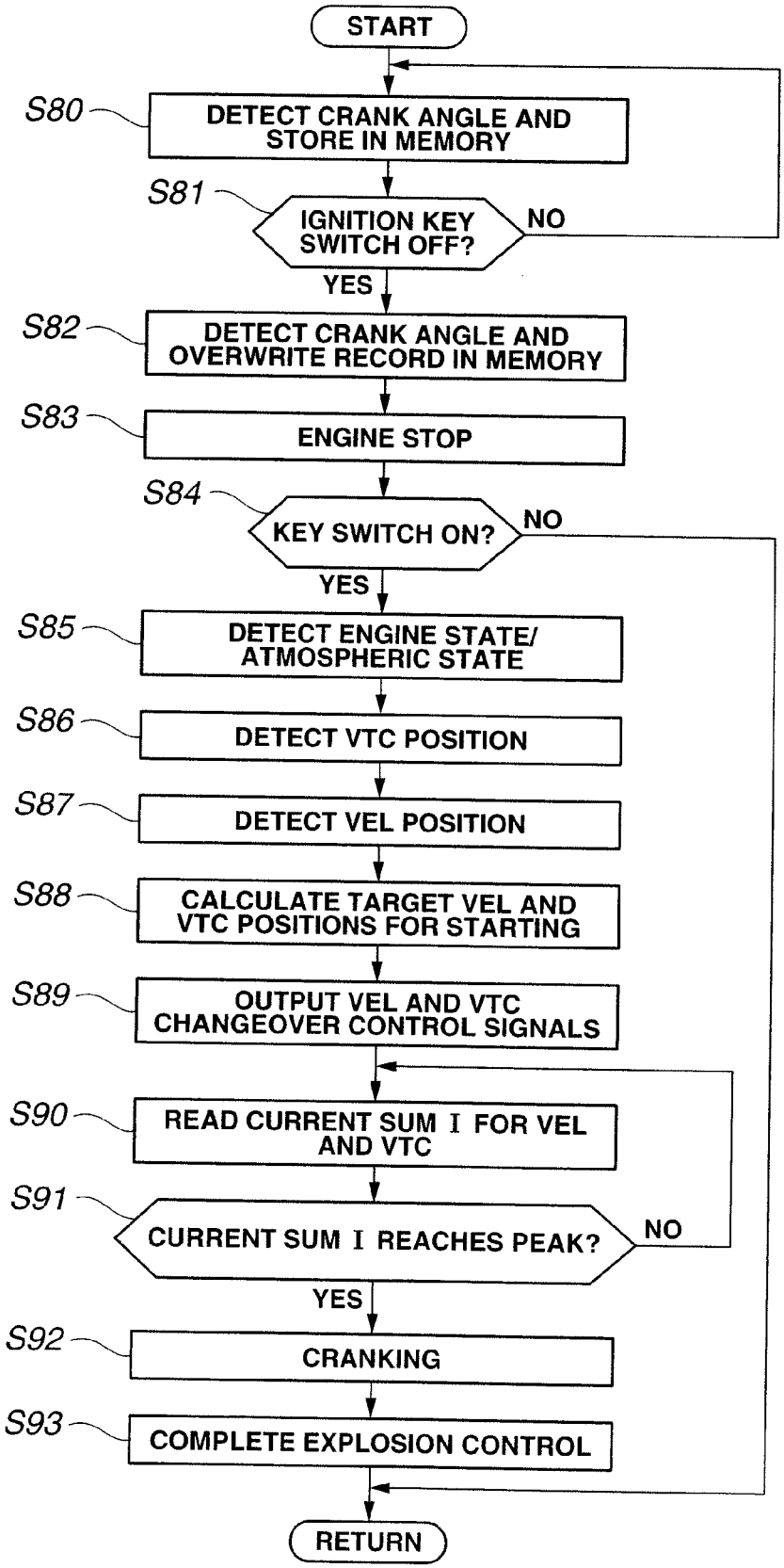
FIG. 13 is a flow chart showing a control process performed by a controller according to a fourth embodiment of the present invention.

FIG. 13 shows a control process performed by controller 22 according to a fourth embodiment of the present invention. Instead of performing the detection of the crank angle at the time of turn-on of the ignition switch as in the process of FIG. 8, the control system according to the fourth embodiment is arranged to perform the detection of the actual crank angle immediately before a preceding stoppage of the engine. In this point, the process of FIG. 12 differs from the process of FIG. 8.

During a previous engine operation, the control system detects the angular position of crank shaft 02 properly with the crank angle sensor 27, and stores the data of the detected position preliminarily in a memory of controller 22 at a step S80.

At a step S81, controller 22 examines whether the ignition key switch is off or not. When the ignition key switch is turned off, the controller 22 proceeds to a step S82, and detects the current angular position of crank shaft 02 with crank angle sensor 27 immediately after the turn-off of the ignition key switch, and stores, by overwriting, the data on the detected angular position in the memory. The data on the detected angular position of crank shaft 02 is preserved in the memory of controller 22 even after the stop of the engine.

At a step S83, controller 22 stores a most recent value of the detected angular position of crank shaft 02 as the angular position of crank shaft 02 if the engine is stopped abruptly as in an engine stall.

At a step S84 following S83, controller 22 examines whether the ignition key switch is on or not. When the ignition key switch is not on, controller 22 proceeds directly to the end of this process for the return operation. When the ignition key switch is on, controller 22 proceeds to a step S85.

At step S85, controller 22 detects the current engine operating state, by reading the signals from the various sensors as in the preceding embodiments. Then, controller 22 detects the current operating or actuating position (current VTC position) of valve timing control mechanism 2 and the current operating or actuating position (current VEL position) of lift varying mechanism 1 as in the second embodiment, respectively, at a step S86 and a step S87; and calculates, at a step S88, the target VEL position of lift varying mechanism 1 and the target VTC position of valve timing control mechanism 2 to achieve a desirable startability, by assuming, as a premise, the angular position of crank angle 02 detected and stored at S82.

At a step S89, controller 22 delivers, to the motor 20, a current for controlling valve lift varying mechanism 1 to the target VEL position, and delivers, to the VTC motor, a current for controlling valve timing control mechanism 2 to the target VTC position. Steps S89~S93 are substantially identical to steps S29~S33 shown in FIG. 8.

In the fourth embodiment, the variable valve actuating system is arranged to detect the actual crank angle at the time of engine stop instead of the timing immediately before a start of the engine. Therefore, the system can reduce the time required to start the engine by eliminating the need for detecting the crank angle at the time of start.

In the fourth embodiment, since the crank shaft 02 is rotating slightly at the time of detection of the crank angle, the system can employ, as the crank angle sensor, a trigger type sensor capable of sensing at time intervals during rotation, instead of a costly absolute angle sensor.

The present invention is not limited to the first through fourth embodiments. The present invention is applicable not only to the intake side, but to the exhaust side as well. Moreover, the present invention is applicable simultaneously to both sides. When the variable valve actuating mechanism is provided on the exhaust side, the variable valve actuating system can vary the temperature at the compression top dead center by controlling the exhaust valve opening and closing timings, and further improve the engine startability by controlling the exhaust side valve actuating mechanism in accordance with the starting crank angle.

Though, in the illustrated embodiments, the engine temperature (or engine coolant temperature) is employed as the engine operating condition other than the crank angle, it is possible to employ the temperature of some other portion, or some other operating condition or parameter. As the atmospheric condition, it is possible to employ the atmospheric pressure having influence on the output torque, instead of, or in addition to, the atmospheric humidity.

The valve actuating mechanism may be of the electric type as in the illustrated embodiment, or may be of a hydraulic type. In the case of the hydraulic valve actuating mechanism, the system may be arranged to control the hydraulic valve actuating mechanism to a desired position before a cranking operation or at an early stage of the cranking operation by driving an electric pump before the cranking operation.

The variable valve actuating mechanism is not limited to the valve lift varying mechanism VEL and/or the valve timing control mechanism VTC. It is possible to employ one of various valve actuating mechanisms. For example, it is optional to employ a cam switching type mechanism arranged to change the valve operation angle stepwise.

According to the first, second, third and fourth embodiments, a variable valve actuating apparatus comprises: a valve actuating mechanism to vary an actual valve operating characteristic of an internal combustion engine; a crank angle sensor to sense an actual crank angle of the engine; and a controller to receive the actual crank angle and to control the valve actuating mechanism to improve a cranking performance. In the above-mentioned variable valve actuating apparatus, the controller is configured to set a target valve operating characteristic in accordance with the actual crank angle, to control the valve actuating mechanism to achieve the target valve operating characteristic, and to perform a cranking operation of the engine in a state in which the valve actuating mechanism is controlled to achieve the target valve operating characteristic.

This application is based on a prior Japanese Patent Application No. 2006-191178 filed on Jul. 12, 2006. The entire contents of this Japanese Patent Application No. 2006-191178 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable valve actuating apparatus for an internal combustion engine, comprising:

a valve actuating mechanism to vary an actual valve operating characteristic of the engine; and a controller configured:

to set a target valve operating characteristic in accordance with a crank angle position of the engine before a start of the engine, and to deliver a changeover control signal to the valve actuating mechanism to control the actual valve operating characteristic to the target valve operating characteristic before an end of a cranking operation of the engine;

wherein the controller is configured to set the target valve operating characteristic to retard an intake valve closing timing after a bottom dead center when the crank angle position before the start of the engine is such that a piston position in a cylinder on an intake stroke or a compression stroke is at or near the bottom dead center.

2. A variable valve actuating apparatus for an internal combustion engine comprising:

a valve actuating mechanism to vary an actual valve operating characteristic of the engine; and a controller configured:

to set a target valve operating characteristic in accordance with a crank angle position of the engine before a start of the engine, and to deliver a changeover control signal to the valve actuating mechanism to control the actual valve operating characteristic to the target valve operating characteristic before an end of a cranking operation of the engine;

wherein the controller is configured to set the target valve operating characteristic in accordance with an engine operating condition including the crank angle position before the start of the engine, and to deliver the changeover control signal to the valve actuating mechanism before a cranking operation or at an initial stage of the cranking operation.

3. A variable valve actuating apparatus for an internal combustion engine, comprising:

a valve actuating mechanism to vary an actual valve operating characteristic of an engine valve of the engine;

a crank angle sensing device to sense an actual crank angle of a crank shaft of the engine; and a controller configured:

to set a target crank angle position in accordance with an engine operating condition including the actual crank angle sensed by the crank angle sensing device, to perform a crank angle adjusting operation to rotate the crank shaft to the target crank angle position, to set a target valve operating characteristic in accordance with the actual crank angle controlled by the crank angle adjusting operation and sensed again by the crank angle sensing device, and to deliver a changeover control signal to the valve actuating mechanism to control the actual valve operating characteristic to the target valve operating characteristic;

wherein the controller is configured to set the target crank angle position so as to advance a piston position in a cylinder on an intake or compression stroke, by a predetermined amount, before a bottom dead center, and to set the target valve operating characteristic of the engine valve which is an intake valve of the engine so as to advance an intake valve closing timing before the crank angle controlled by the crank angle adjusting operation.

4. The variable valve actuating apparatus as claimed in claim 3, wherein:

the valve actuating mechanism is arranged to vary the actual valve operating characteristic which is an intake valve operation angle; and the controller is configured to set the target valve operating characteristic to advance an intake valve closing timing on an advance side of the bottom dead center by decreasing the intake valve operation angle.

5. A variable valve actuating apparatus for an internal combustion engine comprising:

a valve actuating mechanism to vary an actual valve operating characteristic of an engine valve of the engine;

a crank angle sensing device to sense an actual crank angle of a crank shaft of the engine; and a controller configured:

to set a target crank angle position in accordance with an engine operating condition including the actual crank angle sensed by the crank angle sensing device, to perform a crank angle adjusting operation to rotate the crank shaft to the target crank angle position, to set a target valve operating characteristic in accordance with the actual crank angle controlled by the crank angle adjusting operation and sensed again by the crank angle sensing device, and to deliver a changeover control signal to the valve actuating mechanism to control the actual valve operating characteristic to the target valve operating characteristic;

wherein the controller is configured to set the target valve operating characteristic in accordance with the actual crank angle before a start of the engine only when the crank angle adjusting operation fails.

6. A variable valve actuating apparatus for an internal combustion engine, comprising:

a valve actuating mechanism to vary an actual valve operating characteristic of an engine valve of the engine;

a crank angle sensing device to sense an actual crank angle of a crank shaft of the engine; and a controller configured:

to set a target crank angle position in accordance with an engine operating condition including the actual crank angle sensed by the crank angle sensing device, to perforin a crank angle adjusting operation to rotate the crank shaft to the target crank angle position, to set a target valve operating characteristic in accordance with the actual crank angle controlled by the crank angle adjusting operation and sensed again by the crank angle sensing device, and to deliver a changeover control signal to the valve actuating mechanism to control the actual valve operating characteristic to the target valve operating characteristic;

wherein the valve actuating mechanism includes an electric actuator configured to vary the actual valve operating characteristic, and the controller is configured to deliver the changeover control signal to the valve actuating mechanism to control the actual valve operating characteristic to the target valve operating characteristic before a cranking operation, and to start the cranking operation after a peak of current supplied to the electric actuator is reached.

7. A variable valve actuating apparatus for an internal combustion engine, comprising:

a valve actuating mechanism to vary an actual valve operating characteristic of an engine valve in each of a plurality of cylinders of the engine; and a controller to ascertain a crank angle of the engine before a start of the engine, to identify a cylinder having a lower piston position near a bottom dead center on an intake or compression stroke in accordance with the crank angle, to set a target valve operating characteristic in accordance with the piston position in the cylinder having the lower piston position, and to deliver a changeover control signal to the valve actuating mechanism to control the actual valve operating characteristic to the target valve operating characteristic before an end of a cranking operation of the engine.

8. The variable valve actuating apparatus as claimed in claim 7, wherein the controller is configured to set the target valve operating characteristics for the cylinders other than the cylinder having the lower piston position so that the target valve operating characteristics for the cylinders other the cylinder having the lower piston position are identical to the target valve operating characteristic of the cylinder having the lower piston position.

* * * * *